US005201089A

United States Patent [19]

Ferreira

[11] Patent Number: 5,201,089

[45] Date of Patent: Apr. 13, 1993

[54] FOOT SUPPORT APPARATUS AND METHOD

[76] Inventor: Thomas A. Ferreira, P.O. Box 1056, Wellfleet, Mass. 02667

[21] Appl. No.: 948,685

[22] Filed: Sep. 22, 1992

[51] Int. Cl.[5] ..... A61G 1/013; A61G 1/00

[52] U.S. Cl. ..... 5/627; 5/625; 5/628; 128/870

[58] Field of Search ..... 5/625-629, 5/651, 624, 81.1; 128/870, 871

[56] References Cited

U.S. PATENT DOCUMENTS

| | | | |
|---|---|---|---|
| 2,607,050 | 8/1952 | Binschoff | 5/81.1 |
| 3,158,875 | 12/1964 | Fletcher | 5/628 |
| 3,233,255 | 2/1966 | Propst | 5/624 |
| 4,369,982 | 1/1983 | Hein et al. | 5/625 |

FOREIGN PATENT DOCUMENTS

| | | | |
|---|---|---|---|
| 116901 | 5/1943 | Australia | 5/628 |

*Primary Examiner*—Alexander Grosz
*Attorney, Agent, or Firm*—Thomas A. Kahrl

[57] ABSTRACT

A foot support plate adapted for mounting on a foot end of a rigid stretcher comprising a base rectangular plate of rigid construction having connected by a first hinge to a first support arm and a second hinge attached to the base of a second arm, the first and second arms being adapted to be mounted on the support plate for movement between an open position and a closed secured position for securely supporting the foot support plate in a generally perpendicular relationship with said rigid stretcher. The base plate also comprises a series of at least two pins extending an orthogonical relationship for engaging matching sockets in the base of the rigid stretcher for providing an anchoring for the base plate. The support arms are provided with threaded attachment means mounted respectively at the distal ends of said arms having a knob member and a threaded member said threaded member adapted to be fitted in an elongated aperture the distal end of each support arms the threaded members extending inwardly for engagement in tapped holes in the side rail of the backboard. The invention is also directed to a method for protecting for patients of suspected cervical spine injury when encountered in a standing position comprising utilizing the foot support plate.

7 Claims, 1 Drawing Sheet

FOOT SUPPORT APPARATUS AND METHOD

BACKGROUND OF THE INVENTION

Providing on-the-scene trauma life-support methods and procedures is important for protecting traumatized patients with suspected back injuries, particularly automobile accident victims at the accident site prior to admission to emergency facilities of a hospital. Previous methods employed by pre-hospital care providers, typically Emergency Medical Technicians (EMT)/Paramedic personnel, for protecting patients of suspected cervical spine injury, when encountered in a standing position at the scene of an accident, are usually governed by methods developed as part of a well-recognized emergency care program known as the Pre-Hospital Trauma Life Support Program, ("P.H.T.L.S."). In this program, it is the standard procedure to "backboard" patients at prescribed times and conditions while in the standing position. The procedure used in backboarding standing patients is to use triangularly folded bandages to secure the patient at the feet and pelvis area to a stretcher device commonly called a "backboard." Alternatively, the standard procedure used when patients, who have been traumatized from accidents, are encountered, other than standing or otherwise upright when a EMT-/Paramedic team arrives, is to provide routine emergency care which typically includes having the patient sit or lie down.

When the patient is encountered by EMT/Paramedic personnel in the standing position, it is inappropriate for pre-hospital care providers to sit or lie the traumatized patient down without first applying a fitted cervical collar and a full length backboard, while the patient is standing. Preferably, the patient must be tied to the backboard according to a prescribed "backboarding procedure" developed by the National Association of Emergency Medical Technicians in cooperation with the Committee on Trauma of the American College of Surgeons. The reason care providers do not permit these patients to lie down is that automobile accident victims frequently suffer broken necks as a result of being subjected to rapid deceleration during a collision, wherein the person's head, being heavy, is rapidly displaced relative to the neck column, causing a fracture of the neck column. Often such neck fractures, while serious in and of themselves, do not initially sever nerve cords of the spinal column of a patient which would result in serious injury and paralysis. However, any subsequent movement of the injured patient can result in the nerve cords being severed by a fractured bone and causing serious injury. Typically, the injury to the spinal column occurs after the accident, when the victim either moves while trying to extricate him or herself from the damaged automobile, or, having gotten out of the automobile, has occasion to move his/her head down, the most dangerous movement being to look downward, thereby causing the fractured bones to cut the spinal column causing serious and permanent damage.

Prior art methods and apparatus currently utilized by emergency/rescue teams are directed to tying an upright accident victim/patient an upright rigid stretcher device, commonly known as a "backboard," while standing in an upright position. The object of such method is to support a victim on a backboard while standing to minimize movement of the victim and an resulting neck movement. Once supported on the backboard, the victim is manually transported into an ambulance before the transport to the hospital for emergency care. Such prior art backboards utilize cloth ties devices, commonly known as folded bandages, for securing the victim to the backboard consisting of folded triangular wraps, wherein one wrap is used to tie the feet, another is to tie the torso, and another as appropriate could be used to tie the upper torso to the backboard. Backboards currently used by emergency rescue teams have no support for the victim's feet.

During close observation of various techniques, I have found that special precautions must be taken to prevent downward movement of the patient relative to the backboard while backboarding victims in the standing position. This has been viewed in the field and classroom setting, while well trained experienced EMT-/Paramedics perform this task. Using methods from the P.H.T.L.S. program, I have witnessed downward movements of the patient's torso relative to the backboard ranging from ⅜" to as much as 3" in most cases. Therefore, to perform the task of tying a patient to a backboard correctly and to minimize downward movement, it is imperative to take valuable time to perform the task of tying the bandage wraps securely.

In an article published in the Journal of Emergency Medical Science (JEMS), September, 1987; pages 64,65, & 66, the techniques described are quite different. Although the techniques disclosed are faster, there is still downward movements of the patient. Furthermore, great pressure is transferred from the shoulders to the thoracic and cervical spine areas in the JEMS article which may be harmful and is thus undesirable.

Referring to the teaching of the P.H.T.L.S. program, any movement of the patient's arms, legs, shoulders, and pelvis can result in compromise in the entire spinal column. To counteract this, as taught in said program, the backboard when tied to the patient's body becomes a full body splint intended to eliminate movement of such body members and prevent further injury.

As human skills vary from person to person, it is not feasible to ensure uniform quality of care in securely tying the patient to the backboard with sufficient tightness to prevent downward movement of a patient while backboarding the patient who is in the standing position. Accordingly, these prior art devices and methods often fail in their objectives.

Another prior art device discloses in U.S. Pat. No. 3,158,875, Fletcher, shows an "INVALID STRETCHER" incorporating a fabric body portion and a foot support fabric portion for supporting the invalid's feet, including at least one pocket for incorporating a rigid slat. The foot support is adapted to adjust the position of the foot support for invalids of different height, and includes straps for maintaining the invalid's feet immobile in the foot support portion. While the foot support in Fletcher restrains movement of the patient's feet, particularly lateral movement, it is not adapted to support the full weight of the patient to prevent downward movement of the patient's torso relative to the fabric body portion, and associated movement of head and neck.

Such prior art devices, however, have not proven fully effective for complete immobilization of the patient's neck because the tying devices cannot, by themselves, securely hold the victim in position on a stretcher or back board and the victims frequently slump down when they are being moved from the upright position to a generally horizontal supine position for transport. As previously noted, such movement carries the risk of head movement with associated aggravated neck injury, and paralysis.

It is therefore desirable to provide a new, improved back board apparatus and method which is fast to apply thereby reduces delay in providing critical care, is economical, easy to operate, can be retrofitted to back boards currently in use and provides greater immobilization for protection against aggravated neck injury not possessed in prior art stretcher devices or methods.

SUMMARY OF THE INVENTION

The invention relates to a patient support for immobilizing the body of an accident victim to prevent aggravated neck injury associated with cervical spine injury and to a method of immobilizing the neck of an accident victim.

A unique and novel foot support apparatus has been discovered adapted for use with a conventional rigid stretcher used by Emergency Rescue Teams for immobilizing an accident victim, in a standing position, with greater speed, safety, and for providing stabilization of the victim's cervical spine area. In particular, the invention, in the preferred embodiment, is directed to a foot support plate for use in combination with a conventional rigid stretcher apparatus, typically a "backboard," comprising a board of plywood construction having a rectangular rigid configuration and including a plurality of pairs of cloth straps, longitudinally spaced adapted for securing the torso of a patient to the board, particularly when in the standing position. In practice, the backboard arranged in vertical alignment in contact with the back of the patient, and the straps are used to securely tie the patient to the backboard such that the patient can be reoriented from a vertical standing position to a generally horizontal position without moving. The cloth straps typically comprise triangularly shaped fabric bandages formed of folded cloth for tying the torso and foot support straps attached to the foot of the backboard for tying the feet.

In the preferred embodiment, the foot support plate is configured of a metallic plate fastened by a hinged fastener to a foot end of the backboard for supporting the entire weight of the patient, typically for supporting a weight of at least 250 pounds being held in rigid orthogonical relationship to the backboard.

The backboard comprises a central board member of conventional constructions having cut-outs providing hand grip access adjacent side rails provided on the perimeter of the central board member, the central backboard having a length of at least 6 feet, a width of 16" to 18", and constructed of ¾" plywood. The backboard includes a plurality of straps comprising segments of folded cloth fabric, folded in a manner to produce a conventional triangular wrap, commonly called a "bandage wrap," having a support mid-section and two distal ends, with the distal ends being adapted to be tied together for tying the patient securely to the backboard, particularly when in a standing position. The straps are adapted to be wrapped around the feet, the torso and the chest portion of the patient to minimize movement of the torso relative to the backboard such that the victim when secured to the backboard can be moved from a vertical standing position tc a generally horizontal position for movement to an emergency vehicle and transportation to a hospital.

In the preferred embodiment, the plate is adapted to be mounted on the foot end of the backboard and comprises a generally rectangular plate, typically of metallic construction, preferably aluminum, having a first and second end, each end including side hinge members including a first and second side hinge, the first side hinge being secured at one end of the plate to engage a first support arm having a generally triangular configuration, having a hinged end and an apex end, and the second hinge attached to the base of a second support arm also having a generally triangular configuration, said support arms also being of rigid construction, typically of metallic material. The first and second support arms being hingedly mounted at the hinged end on each end of the plate are adapted for movement between an open flat position and a generally perpendicular position with the apex end detachably fastened by a fastening member to the side of the back board in orthogonical relationship with the backboard at the foot end of the backboard for securely supporting the plate in a generally perpendicular relationship with the board member of the backboard. The plate also comprises a plurality of at least two dowel pins of metallic configuration; in parallel/spatial relation positioned on the central portion of the rectangular plate and extending in orthogonical relationship to said plate for engaging matching sockets in the base of the backboard, for securely mounting a back edge of the rectangular plate to the backboard. In the preferred embodiment, the pair of support arms are provided with detachable fastening members comprising threaded knobs positioned respectively at the distal apex ends of said support arms having a knob member and a threaded member, said threaded member adapted to be fitted in an elongated aperture for engagement in matching tapped threaded holes in the side rails of the backboard for holding the plate in rigid perpendicular relationship with the backboard.

The invention is also directed to a method for rapidly immobilizing an accident victim, particularly the accident victim's neck during providing pre-hospital emergency care for patient's of suspected cervical spine injury when encountered in a standing position comprising the steps of: a) providing a backboard having a plurality of straps; b) providing a foot support plate mounted in rigid perpendicular relationship to the backboard attached to the foot end of the backboard; c) positioning the backboard on the back of the torso of the patient, wherein the patient is standing in an upright position; d) wrapping a plurality of straps around the torso of the accident victim in selected positions for securing the patient to the backboard when in a standing position; e) positioning the patient's feet, one at a time, on the foot support plate for rigidly supporting said patient's feet to prevent any downward movement of the patient's feet and torso relative to the backboard and particularly for immobilizing the patient's neck during movement of the combined backboard and patient between an upright position and a generally horizontal position, and f) movement between an accident location and a transportable location such as a rescue vehicle for further transport for medical treatment at a hospital.

The invention will be described for the purposes of illustration only in connection with certain embodiments; however, it is recognized that those persons skilled in the art may make various changes, modifications, improvements and additions on the illustrated embodiments all without departing from the spirit and scope of the invention.

DETAILED DESCRIPTION OF THE PREFERRED EMBODIMENT

Figure 1:
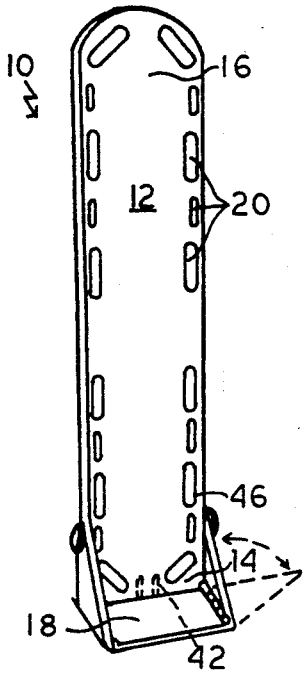
FIG. 1 is a perspective view showing the backboard in an upright position with the foot support apparatus attached.
Figure 2:
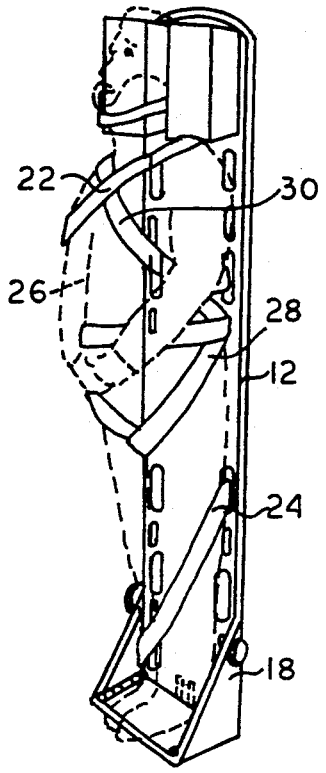
FIG. 2. is a perspective view from the side showing a accident victim standing.

As shown in the Figs., FIGS. 1 and 2 show a combination of backboard and foot support apparatus 10 comprising an elongated backboard 12 having a foot portion 14 and a head portion 16 and a foot support plate 18 removably attaohed to the foot portion 14 of said baokboard 12.

The backboard 12 is provided with a plurality of elongated hand holds 20 extending along the lateral sides of the backboard 12 and include a plurality of straps 22, as shown in FIG. 2. The straps 22 are attached in pairs to respective hand holds 20 there being a bottom pair with one shown as 24 for securing a patient shown at 26 in FIG. 2 for securing the patient's legs, a middle pair 28 for securing the mid-section of the patient's torso and a top pair 30 for wrapping around the patient's shoulders to hold the patient 26 against the backboard 12 and to minimize movement of the patient relative to the backboard 12.

Figure 3:
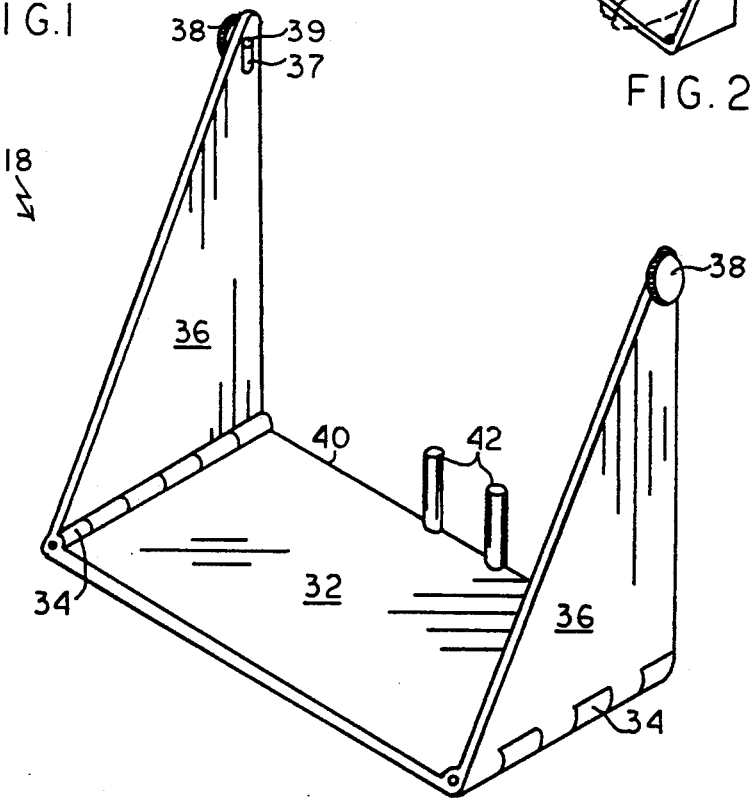
FIG. 3 is a perspective view from above of the foot support apparatus.

In FIG. 3 is shown the foot support plate 18 detaohed from the backboard 12 shown in FIG. 1. The foot support plate 18 comprises a base plate 32, having a pair of hinges 34 at opposite ends, and a plurality of substantially rigid side arms 36 extending outwardly from the base plate 32, each having an elongated hole 37 and associated threaded knob 38 positioned at the distal end of each of said side arm with a threaded shaft 39 extending inwardly.

The side arms 36 are of generally triangular shape each having a back edge co-planar with the back of the back 40 of the base plate 32. Two spaced apart round dowel pins 42 are positioned on the back of the base plate 32 extending in perpendicular relationship therewith.

Figure 4:
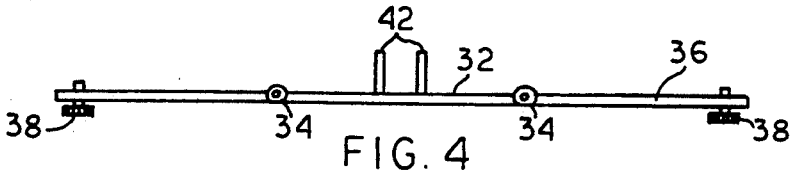
FIG. 4 is a front view of the foot support apparatus shown in the open flat position.

As shown in FIG. 1 the foot support plate 18 is securely attached to the foot portion 14 of the back board 12 by inserting pins 42 in apertures or sockets 44 provided in the foot portion tion 14, fitting the back 4o and edges 38 of the foot support 18 against the foot portion 14 of the said backboard and attaching the pair of knobs 38, by threading each shaft 39 into threaded inserts or holes 46 provided in the sides of the backboard 12. As shown in FIG. 4, the foot support plate 18 adapted to be folded flat for storage with side arms folded out and away in the open position.

What is claimed is:

1. A foot support plate integrated with portable patient support apparatus for supporting an upright trauma patient comprising:

a) a portable patient support means for providing rigid support of the head and back of the patient comprising a backboard having a head end and a foot end;

b) strap means for securing the patient when in the upright position to the backboard comprising a plurality of pairs of spaced-apart fabric straps, on opposite sides of the backboard; and c) a foot support plate, detachably positioned in an orthongonal relationship to the footend of the backboard comprising a rectangular base plate of rigid construction having a first and a second end; first hinge being attached at the first end and a second hinge being attached to the second end; a pair of side support arms attached to the ends of the base plate by said hinges, said base plate and side support arms adapted to move between a flat storage position and a foot supporting position with the side arms substantially perpendicular to said base plate, said side plates further comprising threaded fastening means adapted to releasably engage matching threaded holes in the sides of the backboard, a plurality of dowels positioned in the central portion of the base plate, extending in orthogonical relation thereto and adapted to releasably engage with matching sockets in the bottom edge of the backboard, said foot support plate attached at the foot end of the patient support means for supporting the entire weight of the patient in an initial upright position by providing a rigid support for the patient's feet.

2. The apparatus of claim 1 wherein the patient support means includes central rigid board adapted to be placed against the back of a patient for rigid support.

3. The apparatus of claim 1 wherein the patient support means is adapted to be placed against the torso of an accident victim when said accident victim is in a standing, upright position.

4. The apparatus of claim 1 wherein the strap means comprises seqments of folded cloth fabric folded to provide a triangular wrap having a support mid-section and two distal ends, the distal ends adapted to being tied together over the torso of a patient.

5. The apparatus of claim 1 wherein the strap means is adapted to be wrapped around a combination of victim and patient support means to tie the torso of the patient to this patient support means for holding the torso of the patient against the patient support means such that patient can be moved from a generally vertical standing position to a horizontal transport position.

6. The apparatus of claim 1 wherein the threaded means comprises a pair of knobs permitting detachment of the foot support plate and said hinge means permits movement of the foot plate apparatus between a retracted position located against the handles of the stretcher and an extended position wherein the base plate is in orthogonical relationship to said patient support apparatus.

7. A method for protecting against aggravated neck injury of an upright accident victim comprising the steps of:

a) providing a patient support apparatus having a central rigid board, b) attaching a foot support plate comprising a rectangular base plate of rigid construction having a first and a second end; first hinge being attached at the first end and a second hinge being attached to the second end; a pair of side support arms attached to the ends of the base plate by said hinges, said base plate and side support arms adapted to move between a flat storage position and a foot supporting position with the side arms substantially perpendicular to said base plate, said side plates further comprisign threaded fastening means adapted to releasably engage matching threaded holes in the sides of the backboard to the foot of the patient support apparatus said attaching step comprising moving said foot support plate from the flat sotrage position to the foot supporting position, and fastening the threaded means into the threaded holes;

c) placing the pat support apparatus on the torso of a standing accident victim wherein the said victim is standing in an upright position;

d) wrapping a plurality of straps around the torso of the accident victim in selected positions for attached the for securing the torso of the victim to the patient support apparatus means in a manner;

e) placing the victim's two feet on the foot support plate attached to one end of the patient support apparatus for preventing displacement of the victim's torso relative to the patient support apparatus during movement of the combination patient support apparatus and victim between an upright position and a horizontal position; and f) moving the victim secured to the patient support apparatus between an upright standing position and a horizontal position for movement for transport by manual means wherein the victim is held in a secure position attached to the patient support apparatus by the combined action of the foot support plate preventing downward movement of the victim's feet relative to the patient support apparatus and by the binding action of the tying apparatus binding the torso of the victim to the patient support apparatus and the rigid board against the patient's back.

* * * * *